United States Patent [19]

Hanson et al.

[11] 4,261,133

[45] Apr. 14, 1981

[54] TOY CAR CRUSHING APPARATUS

[75] Inventors: Steven P. Hanson, Brea, Calif.; Palmer J. Schoenfield, Evanston; Harry Disko, Barrington, both of Ill.

[73] Assignee: Marvin Glass & Associates, Chicago, Ill.

[21] Appl. No.: 114,849

[22] Filed: Jan. 24, 1980

[51] Int. Cl.[3] ..... A63H 33/30; A63H 5/00; B30B 15/06

[52] U.S. Cl. ..... 46/40; 46/39; 46/175 R; 100/295; 100/DIG. 1

[58] Field of Search ..... 46/39, 40, 192, 175 R; 428/2; 241/198 R; D99/99; D15/20; 100/1, 2, 177, 178, 288, 295

[56] References Cited

U.S. PATENT DOCUMENTS

| | | | |
|---|---|---|---|
| 747,230 | 12/1903 | Ross | 100/288 |
| 2,726,025 | 12/1955 | Lochner | 100/288 |
| 3,170,389 | 2/1965 | Parks | 100/DIG. 1 |
| 3,439,608 | 4/1969 | Huston, Sr. | 100/DIG. 1 |
| 3,457,668 | 7/1969 | Genin | 46/40 |
| 3,590,749 | 7/1971 | Burns et al. | 100/288 |
| 3,651,754 | 3/1972 | Forest | 100/DIG. 1 |
| 3,670,450 | 6/1972 | Morosawa | 46/40 |
| 3,741,706 | 6/1973 | Conley et al. | 100/288 |
| 3,780,647 | 12/1973 | Reimers | 100/DIG. 2 |
| 4,055,914 | 11/1977 | Ieda et al. | 46/192 |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

A novel toy simulating a crusher for compressing junk cars includes in combination, one or more small toy cars having a hollow body shell formed of readily deformable, thin, sheet material and a crushing mechanism including a guideway with a slide movable in the guideway to press a first wall against a toy car placed therein. A second wall is movable into and out of a stop position between sides of the guideway and faces the first wall. A manually operable mechanism is provided for moving the slide toward the second stop wall and shell of the toy car disposed in the guideway is compressed or crushed and thereafter the mechanism is operated to remove the crushed car from the guideway. A sound generator is activated by movement of the slide when crushing a car sheel to provide a realistic sound effect of a car being crushed.

16 Claims, 9 Drawing Figures

TOY CAR CRUSHING APPARATUS

BACKGROUND OF THE INVENTION

1. Field of the Invention

The present invention relates to play toys for young children and more particularly, to a toy apparatus which simulates a real life, large, complex car crusher of the type used for compressing junk cars at a junk yard. The apparatus includes means for making small toy cars having a hollow body shell formed of readily deformable sheet material and during play, these small toy cars are crushed and deformed in a crushing mechanism to form blocks of junk metal resembling real life vehicles that have been converted into scrap metal bundles.

2. Description of the Prior Art

A wide variety of toys have been developed which simulate large and complex machinery and mechanisms in real life. Toy cars, trucks and motor vehicles of all types have been produced for a wide variety of purposes and different types of play.

OBJECTS OF THE PRESENT INVENTION

It is an object of the present invention to provide a new and improved play toy apparatus for young children and the like and more particularly, a new and improved toy apparatus simulating a real life, motor vehicle crushing mechanism of the type used for crushing and compressing junk cars at junk yards into bundles or blocks of scrap metal.

It is another object of the invention to provide a new and improved toy car or motor vehicle having a hollow body shell formed of readily deformable, thin sheet material suitable for crushing or compressing in a toy crusher apparatus.

Yet another object of the present invention is to provide a new and improved manually controlled, crushing apparatus adapted to crush and compress small toy cars into blocks or bundles of scrap iron resembling crushed junk cars.

Another object of the present invention is to provide a new and improved toy apparatus of the character described which closely and accurately simulates the action of a real life, motor vehicle crushing operation in a junk yard.

Still another object of the present invention is to provide a new and improved toy apparatus of the character described which is suitable for long hours of interesting and educational play for young children and the like.

SUMMARY OF THE INVENTION

The foregoing and other objects and advantages of the present invention are accomplished in a new and improved play toy apparatus which closely and accurately simulates a real life, car crushing system of the type used in junk yards for compressing junk cars into blocks or bundles of scrap metal. The apparatus includes a toy car having a hollow body shell formed of readily deformable, thin sheet material and a crusher mechanism having a guideway with a slide supported for reciprocal movement. The slide includes a first wall adapted to engage and compress a toy car placed in the guideway against a second wall which is movable into and out of a stop position between the sides of the guideway. A manually controlled mechanism is provided for moving the slide toward the second stop wall to compress the thin body shell of the car in the guideway, and thereafter, the crushed car is discharged from the apparatus so that the next car crushing operation may begin. Apparatus is also provided for making small, toy cars from thin sheet material to supply the needed toy cars for the operation.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
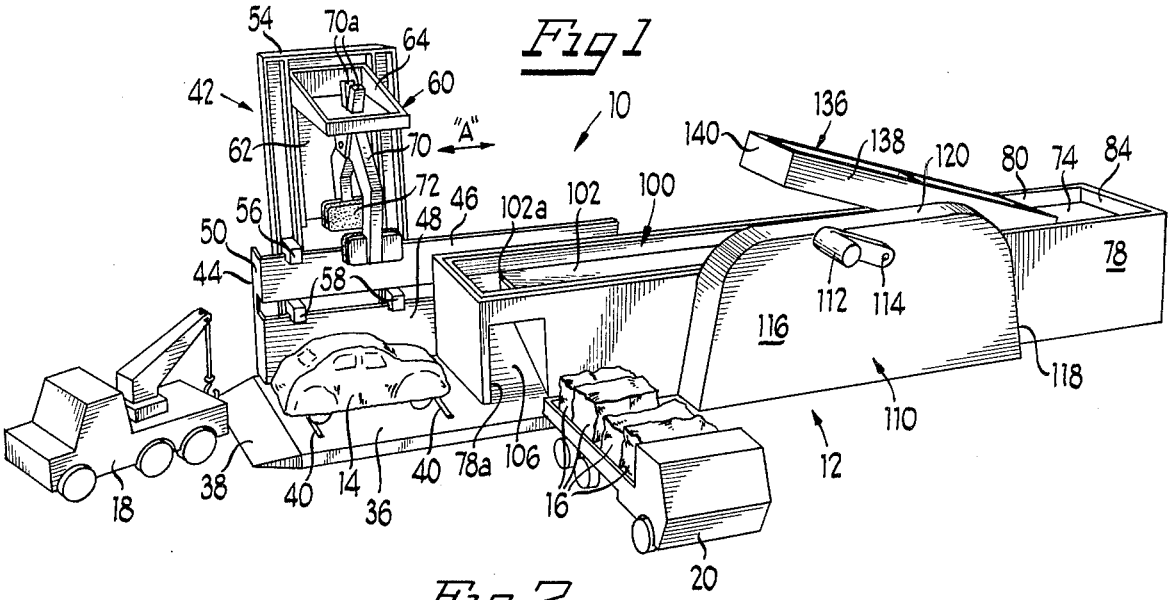
FIG. 1 is a front perspective view of a new and improved toy car crushing apparatus constructed in accordance with the features of the present invention and illustrated in a condition ready for play.

Referring now more particularly to the drawings, in FIG. 1 is illustrated a new and improved toy car crushing system constructed in accordance with the features of the present invention and referred to generally by the reference numeral 10. The system includes a toy car crushing apparatus 12 adapted to closely simulate the action of a real life mechanism and in accordance with the present invention, especially adapted to crush and compress small toy cars or motor vehicles 14 into smaller, generally rectangular-shaped bundles or blocks resembling chunks of scrap metal 16. The junk cars 14 are brought to the crusher 12 with a toy wrecker 18 and after crushing, the scrap metal blocks or bundles 16 are loaded onto a toy delivery truck 20 for hauling away.

Figure 2:
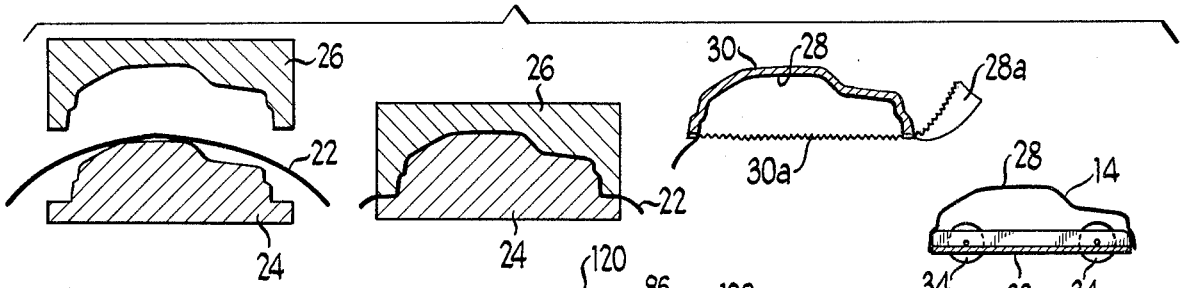
FIG. 2 is a schematic diagram illustrating a mechanism for fabricating or molding toy cars for use in the car crushing apparatus of FIG. 1.

In accordance with the invention, small toy cars 14 may be fabricated for use with the crusher 12 from small, rectangularly-shaped pieces 22 of thin, flexible, mold-deformable, sheet material which can be readily molded into shape with a male and female mold 24 and 26 respectively, as shown in FIG. 2 in schematic form. The sheet material may comprise a metallic material such as aluminum foil to provide a semi-permanent shape of a finished body shell 28 for the cars 14. After the molding operation is completed, the shaped body shell 28 is placed in a female mold 30 having a serrated peripheral edge 30*a* to facilitate removal by tearing of the excess flashing material 28*a* around the lower edge of the finished molded shell. The finished shell may then be mounted on a small rectangular, chassis or base 32 having pairs of front and rear wheels 34 so that a finished toy car 14 then closely resembles in miniature, an automobile or other motor vehicle which is ready for the junk yard.

It should be noted from FIG. 2, that the molded, deformable, thin, flexible shell 28 is not permanently attached to the supporting chassis structure 32 of the vehicle and accordingly, the shell is readily removed from a chassis by lifting the shell upwardly. The vehicle chassis 32 and wheels 34 thus remain intact for subsequent use with another molded, vehicle body shell 28.

In accordance with the present invention, the crushing mechanism 12 includes an elongated generally rectangular base or receiving platform 36 having a sloping ramp 38 at the receiving end to accept the cars 14 brought in by the wrecker 18 during play. On the upper surface of the receiving platform, there is provided a pair of spaced apart transversely extending, wheel positioning, curbs or rails 40 adapted to maintain a car 14 in position on the platform ready for pick up by a traveling lift mechanism 42.

Figures 3, 4, 5:
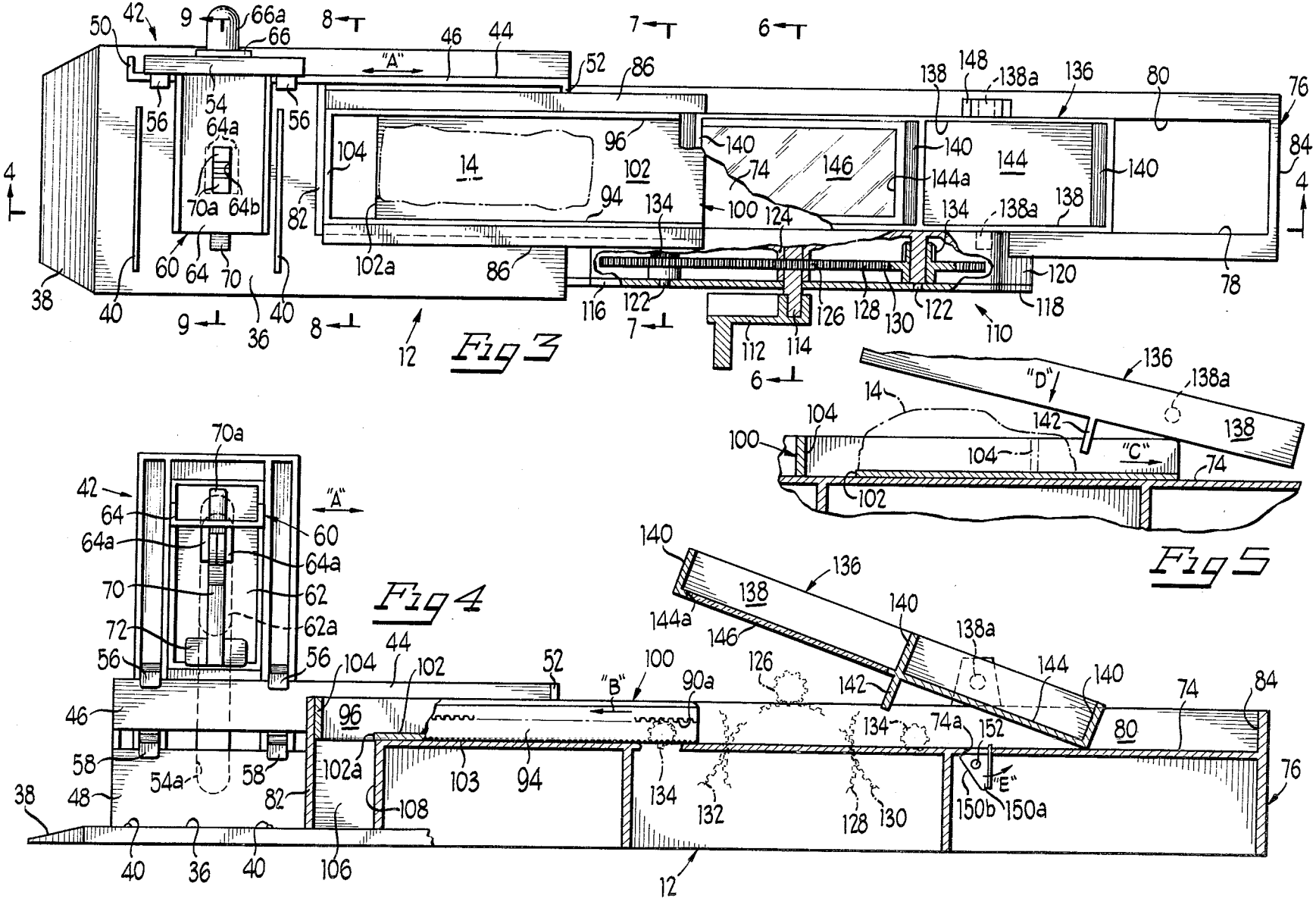
FIG. 3 is a top plan view of the apparatus of FIG. 1 with portions broken away and in section for illustrating internal components thereof.
FIG. 4 is a longitudinal, vertical, cross-sectional view taken substantially along lines 4—4 of FIG. 3.
FIG. 5 is a fragmentary, vertical, cross-sectional view, similar to FIG. 4, but showing operative components in a different operative position.

The lift is designed to raise the thin body shell 28 of the car off the chassis and is adapted for manually controlled, horizontal sliding movement, longitudinally along one side of the receiving platform 36 as designated by the arrow "A" (FIG. 1). The lift mechanism is supported on a fence-like structure 44 extending vertically upwardly along the back side of the receiving platform and, the fence includes a pair of spaced apart upper and lower horizontal rails 46 and 48 interconnected at the ends by upstanding end or stop posts 50 and 52 (FIG. 3).

Figure 9:
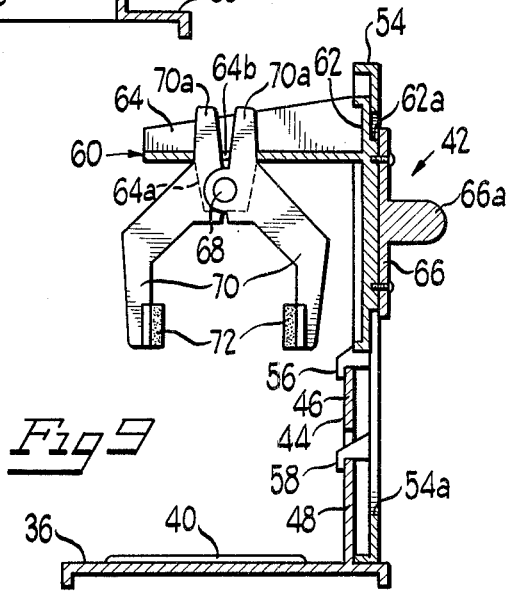
FIG. 9 is a transverse, vertical cross-sectional view taken substantially along lines 9—9 of FIG. 3.

The lift mechanism includes a generally rectangular-shaped, vertically extending support frame 54 mounted for horizontal sliding movement on the fence rails 46 and 48 by pairs of upper and lower hangers 56 and 58, which protrude outwardly of the frame to ride along the upper edge portions of the fence rails as illustrated best in FIG. 9. The support frame includes a vertical wall panel formed with an elongated, vertically extending and centrally disposed slot 54*a* and the slot accommodates a manually controlled, vertically slidable, L-shaped lift member 60. The lift member includes a generally rectangular-shaped vertical leg 62 and an outwardly and forwardly extending, integrally formed arm 64 at the upper end. The vertical leg 62 includes a rearwardly extending, vertically elongated racetrack-shaped key 62*a* on the backside and the key is seated for sliding movement in the slot 54*a* in the supporting frame 54. A cover plate 66 with a handle or knob portion 66*a* extending rearwardly therefrom is attached by screws to the rear face of the key 62*a*. The knob is used for conveniently manipulating the lift up and down as well as horizontally along the supporting fence rails.

The generally horizontally and forwardly outwardly extending arm 64 includes a bottom wall and a pair of downwardly extending brackets 64*a* disposed on opposite sides of a slot 64*b* (FIG. 3) formed in the horizontally extending bottom wall. These brackets support an axle pin 68 on which is pivotally mounted a pair of scissor-like gripping arms 70 having relatively long, downwardly depending lower segments supporting gripping pads 72 having resilient material on the face. The pads are adapted to grip the opposite sides of the body shell 28 of a car 14 placed in a ready position on the platform 36 between the rails 40.

Upper end portions 70*a* of the scissors-like arms project upwardly through the slot 64*b* to provide convenient finger gripping handles which can be pinched together to spread the pads 72 farther apart. Subsequently, release of the handles permits the greater weight of the lower portions of the arms below the axle 68 to move the pads into gripping contact with opposite sides of a car for lifting the shell thereof upwardly away from the chassis and wheels.

When a car 14 is securely gripped between the pads 72 of the scissors-like arms 70, the L-shaped lift 60 may then be moved upwardly on the frame 54 by grasping the back plate lift knob 66*a* and the car and lift 42 may then be moved horizontally along the platform 36 for eventual placement of the car on the bottom wall 74 of an elongated guideway structure or base 76.

Figure 6:
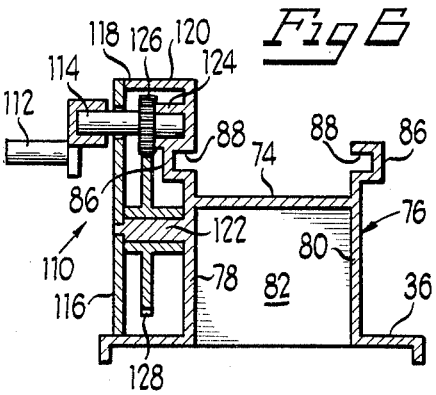
FIG. 6 is a transverse, vertical, cross-sectional view taken substantially along lines 6—6 of FIG. 3.
Figure 7:
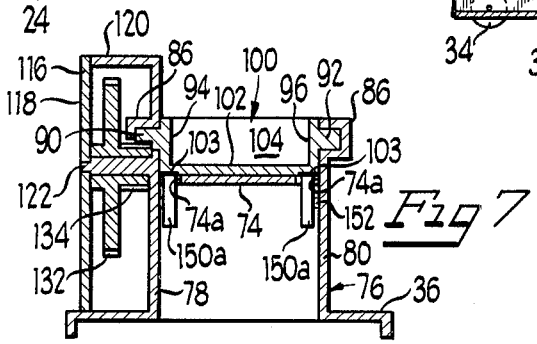
FIG. 7 is a transverse, vertical, cross-sectional view taken substantially along lines 7—7 of FIG. 3.
Figure 8:
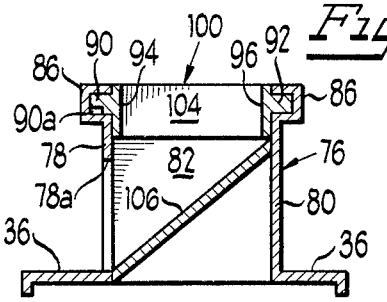
FIG. 8 is a transverse, vertical, cross-sectional view taken substantially along lines 8—8.

The elongated base structure 76 has an inverted, channel-shaped transverse cross-section as shown in FIGS. 6, 7 and 8 and includes a pair of upstanding front and rear sidewalls 78 and 80 extending upwardly above the level of the receiving platform 36. The guideway or base structure also includes an end wall 82 adjacent the receiving platform and an upstanding end wall 84 at the opposite end. The front and rear longitudinal sidewalls 78 and 80 are provided with upper edge portions 86 projecting above the level of the guideway bottom wall 74 and these portions are formed with a channel-shaped transverse cross-section to provide a pair of opposite, facing recesses or keyways 88 (FIG. 6) for receiving respective elongated ribs 90 and 92 formed on the outside walls of a pair of front and rear longitudinal sides 94 and 96 of a slide 100 mounted for reciprocal longitudinal sliding movement on the guideway bottom wall 74 disposed between the front and rear sidewalls 78 and 80 of the guideway.

The slide 100 has a channel-shaped, transverse cross-section and includes a bottom wall 102 and a transverse, end or stop wall 104 adjacent the end wall 82 of the guideway structure. As best shown in FIGS. 3, 4 and 5, the bottom wall 102 of the slide is adapted to support a car 14 placed thereon by the lift mechanism 42, but the bottom wall terminates short of the stop wall 104 (as best shown in FIGS. 3, 4 and 5) to provide a discharge slot 102*a* in the bottom of the slide so that after a car is compressed into a smaller, scrap metal bundle 16, the bundle 16 is small enough to pass downwardly through the slot for discharge when the slide is positioned as shown in FIGS. 3 and 4.

In this position, the slot 102*a* is directly above a discharge chute formed by a forwardly and downwardly sloping bottom wall 106 and an inside vertical wall 108 parallel of the guideway end wall 82. The front sidewall 78 of the guideway 76 is formed with a discharge outlet 78*a* (FIG. 1) so that the compressed scrap metal bundles 16 will pass through the slot 102*a* in the bottom wall of the slide and onto the sloped discharge chute bottom wall 106 to pass out the discharge opening 78*a* onto the platform 36 ready for pick up and placement on the truck 20 as illustrated.

Referring to FIGS. 3 and 5, the toy cars 14 are deposited on the bottom wall 102 of the slide 100 while the slide is in a receiving and discharge position at the left end of the guideway 76 as illustrated, and in this position, the end or stop wall 104 of the slide is adjacent the end wall 82 of the guideway 76. The toy car is deposited in a manner with the longitudinal axis of the car extending longitudinally of the slide as illustrated and it will be noted that the discharge slot 102*a* in the bottom wall of the slide is not large enough to permit the car to pass downwardly therethrough.

In accordance with the present invention, the slide 100 is movable longitudinally in the guideway 76 by means of a crank operated, motor mechanism 110 having a manual crank handle 112 carried on a crank shaft 114 extending outwardly from a front wall 116 of a housing 118 on the outside of the guideway front wall 78. An inside wall of the housing 118 is formed by an upward extension of the front wall 78 of the guideway as shown in FIGS. 6 and 7 and the housing also includes a peripheral end and top wall 120 integrally joined to the guideway front wall 78.

As illustrated in FIGS. 3, 6 and 7, the front wall of the guideway is formed with a plurality of spaced apart outwardly and transversely extending shafts 122 supported at their outer ends in apertures provided in the outer housing wall 116. Above the central shaft 122, the front sidewall is formed with a hollow sleeve 124 also projecting outwardly thereof to support an inner end portion of the crank shaft 114 which projects outwardly through another opening in the outer housing wall 116 to receive the crank handle. Intermediate the ends, the crank shaft 114 is formed with an integral drive gear 126 which is drivingly engaged with the teeth of a larger diameter, idler gear 128 mounted on the center shaft 122 spaced directly therebelow. As illustrated in FIG. 4, turning of the crank shaft 114 by the crank handle 112 causes the gear 128 to rotate in an opposite direction and this gear is meshingly engaged with a pair of driven gears 130 and 132 on opposite sides thereof and having substantially the same diameter. Each of the driven gears 130 and 132 is mounted on a projecting shaft 122 and is formed with a hollow, central, bearing sleeve or journal.

As shown in FIGS. 4 and 7, the bearing sleeves of the gears 130 and 132 are formed with driving teeth 134 thereon which teeth are adapted to drivingly engage a row of rack-like teeth **90*a* formed on a lower surface of the front elongated rib on the slide 100. As illustrated by the curved arrows associated with the gears in FIG. 4, when the crank handle 112 is turned in a counterclockwise direction, the gear teeth 134 on the respective gears 130 and 132 are adapted to engage the rack teeth 90*a* and cause the slide 100 to move from right to left as indicated by the arrow "B" in FIG. 4 towards a leftward, receiving and discharge position. On the other hand, rotation of the crank 112 in a clockwise direction causes the slide 100 to move from left to right as indicated by the arrow "C" in FIG. 5 toward a "car compressing or crushing position" wherein the stop wall 104 of the slide engages the end of a car 14 placed in the slide to apply crushing pressure against the hollow shell 28**.

In accordance with the present invention, the car crusher apparatus 12 includes a stop member 136 mounted for rockable movement about an axis transverse to the guideway 76 on a pair of stub axles **138*a*. The axles project outwardly from opposite sides of a pair of elongated parallel sidewalls 138 and sidewalls are integrally interconnected by a plurality of transverse, cross-walls 140. A middle cross-wall includes a downdardly depending, integral stop wall 142 adapted to move into and out of a stop position between the sidewalls 94 and 96 of the slide 100 when the slide is moved into the position as shown in FIG. 5 beneath the pivotal stop member 136. The stop member is also formed with a bottom wall 144 integral with the cross-walls and above the stop wall 142 and the bottom wall is formed with a large, rectangular opening 144*a* adjacent the left hand end having a transparent window 146 mounted in the opening so that the car compression chamber or space in the guideway below can be viewed as the crushing action takes place. The crushing chamber is formed by the end stop walls 104 and 142, the side walls 94 and 96 of the slide 100, the bottom wall 102 of the slide and the bottom wall 144 of the rockable stop member 136. As the slide is moved toward the right, the stop walls crush the car along an end to end axis to form the bundle of scrap metal 16 which then rests on the bottom wall 74 of the guideway in the slot 102*a*** when the crushing action is completed.

One supporting axle **138*a* of the stop member 136 is mounted in an upstanding bracket 148 on the rear sidewall 80 of the guideway structure and the opposite axle is mounted in an upwardly extending portion of the opposite sidewall 78 forming a back wall of the housing 118. Referring to FIG. 5, the lower edges of the opposite sidewalls 138 of the stop member are adapted to engage the upper edges of the sidewalls 94 and 96 of the slide 100 as the slide is moved from left to right by the crank handle 112. As this occurs, the right hand ends of the sidewalls 94 and 96 engage the lower edges of the sidewalls 138 causing the stop member to pivot in a counterclockwise direction about the supporting axles 138*a* as indicated by the arrow "D" in FIG. 5. When this occurs, the stop wall 142 moves downwardly into a stop position between the opposite sidewalls 94 and 96 of the slide and in this position the wall confronts and faces one end of the toy car 14 and the stop or end wall 104 of the slide. Continued movement from left to right of the slide 100 begins to compress and crush the hollow body shell 28 of the car until finally the shell material is compressed into a scrap metal block 16. The crank handle 112 is then rotated in a counterclockwise direction and this causes the slide to move back from right to left as shown by the arrow "B" in FIG. 4. During return movement, the compressed scrap metal block 16 is supported on the bottom wall 74 of the guideway structure 76 and an edge of the slot 102*a* of the bottom wall 102 of the slide engages the scrap metal block to move it to the left until the discharge slot 102*a* is aligned with opening 78*a* in the front wall 78** of the guideway.

When the slide is fully returned to the position shown in FIG. 4, the scrap metal bundle falls downwardly onto the sloping discharge wall 106 between the end wall 82 and the wall 108 of the guideway discharge chute and slides out onto the platform 36 for loading onto the toy truck 20.

The sidewalls 94 and 96 of the longitudinally movable slide 100 are effective to cam the rockable stop member 136 into and out of the stop position and in this position, the stop wall 142 engages the car to exert pressure against an end of the shell as the opposite wall 104 of the slide moves closer. When the compression is completed, the stop wall 104 of the slide is in the position shown in dotted lines and the ends of the sidewalls 94 and 96 are against the end wall 84 of the guideway 76 and further leftward movement of the slide is stopped. In this position, the compressed car shell or bundle of scrap metal 16 is left resting on the bottom wall 74 of the guideway 76 in the slot **102*a* rather than the bottom wall 102 of the slide 100. Accordingly, when the slide is returned from right to left, back towards the receiving discharge position, the right hand edge of the slot 102*a* carries the compressed scrap metal bundle toward the left until the slot 102*a*** is aligned over the discharge chute of the guideway.

In accordance with the invention, the crusher includes a sound generator in the form of one or more vibrating metal reed-like mechanisms 150 having an upstanding segment 150*a* (FIG. 7) with an upper end adapted to engage a row of serrations 103 (FIG. 4) on the underside of the bottom wall 102 of the slide when the slide moves back and forth during operation. The reed segment 150*a* extends upwardly through a slot(s) 74*a* in the bottom wall 74 of the guideway structure.

As illustrated in FIG. 4, the sound generator mechanism 150 includes a base portion 150*b* at right angles to the segment 150*a* and the base is pivotally secured to an adjacent sidewall 78, 80 of the guideway structure on a pivot pin 152 so that the sound generator mechanism may pivot freely in a counter-clockwise direction as indicated by the arrow "E" as the slide serrations 103 pass across the upper end of the segment 150*a* during a return stroke of leftward travel (Arrow "B") of the slide after crushing of a car shell. This free pivotal movement permits the upper end of the reed-like segment 150*a* to move downwardly away from the serrations of the slide and little, if any, sound is generated as the slide is returned to discharge a crushed car shell. On the other hand, when the slide is moved to the right (Arrow "C") to crush a car shell, the upper edge of the base 150*b* of the sound generator mechanism 150 engages the underside of the bottom wall 74 of the guideway and this engagement limits pivotal movement of the base in a clockwise direction and thus retains the upper end or tip of the reed-like element 150*a* in position to be engaged by the serrations 103 on the slide. This engagement during rightward travel of the slide while crushing a car shell develops an audible sound which resembles the noise that would be developed as a vehicle is crushed or compressed. The generation of the "crushing" sound by the sound generator mechanism 150 adds realism to the toy crusher during play and provides an attractive feature for the toy.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy apparatus simulating a crusher for compressing cars comprising:

a toy car having a hollow body shell formed of readily deformable thin sheet material;

a crusher comprising a guideway having a fixed bottom wall and a pair of fixed, spaced apart sides, slide means supported for reciprocal movement in said guideway including a first end wall adapted to crushingly engage a car in said guideway and a pair of sidewalls nested between said sides of said guideway, pivotal means forming a closeable car crushing chamber mounted for pivotal movement about an axis transverse of said guideway and including a top wall movable between a sloping position open at one end to receive a toy car carried by said slide means along said guideway, and a closed position, said chamber forming means being pivotal from said open position toward a closed position when said top wall is parallel of said bottom wall to confine a toy car in said crushing chamber and including a second end wall depending from said top wall movable into and out of a stop position between said side walls and facing said first end wall for engaging said car, and means for moving said slide means toward and away from said first end wall for crushing the body shell of said toy car disposed between said end walls.

2. The toy apparatus of claim 1 including means for camming said slide means to position said second end wall in said stop position when said slide means is moved toward said first end wall.

3. The toy apparatus of claim 1 wherein said top wall is positioned in parallel above said bottom for confining a car in said guideway as the car is crushed by engagement with said first and second end walls.

4. The toy apparatus of claim 1 wherein said second end wall and top wall are integrally connected in a single element supported for pivotal movement relative to said guideway.

5. The toy apparatus of claim 2 wherein said camming means comprises a pair of engageable cam elements, and one of said elements is movable with said slide means.

6. The toy apparatus of claim 5 wherein the other of said cam elements is movable with said second end wall.

7. The toy apparatus of claim 1 including a discharge chute adjacent one end of said guideway, said slide means including means for moving a toy car into position for discharge through said chute after it is crushed between said first and second walls into a smaller block.

8. The toy apparatus of claim 7 wherein said bottom wall of said slide means includes a discharge opening therein dimensioned to pass a crushed toy car into said discharge chute but prevent a toy car from passing into said chute before crushing has been accomplished.

9. The toy apparatus of claim 1 including a receiving platform for said toy cars at a level below said guideway and manually controlled lift means for elevating the body shell from a toy car in position on said platform and moving the shell above said guideway for deposit thereon.

10. The toy apparatus of claim 9 wherein said lift includes a pair of pivotally supported arms having depending lower end portions for engaging and lifting opposite sides of the shell of a toy car in position on said platform.

11. The toy apparatus of claim 10 wherein said arms are biased to grip and hold a car shell between said lower end portions and includes upper segments adapted to be manipulated to release said car shell on said guideway.

12. The toy apparatus of claim 9 wherein said lift means includes a carriage supported for manually controlled vertical movement and horizontal movement between said receiving platform and said guideway.

13. The toy apparatus of claim 1 wherein said toy car includes a base supported on wheels and said hollow body shell is removably mounted on said base for upward separation therefrom.

14. The toy apparatus of claim 1 including sound generator means for producing a noise resembling the sound of a car being crushed as said slide is moved in a direction in said guideway to crushingly engage a car.

15. The toy apparatus of claim 14 wherein said sound generator means is movable to minimize the generation of sound when said slide is moved in an opposite direction.

16. The toy apparatus of claim 14 wherein said sound generator means includes a vibrating reed having an end engaged by a serrated surface on said slide for generating said noise.

* * * * *